US005724922A

United States Patent [19]

Agata

[11] Patent Number: 5,724,922

[45] Date of Patent: Mar. 10, 1998

[54] LOW-TEMPERATURE STEAM GENERATOR

[75] Inventor: Akihiko Agata, Isahaya, Japan

[73] Assignee: Shin-Ei Kabushiki Kaisha, Nagasaki-ken, Japan

[21] Appl. No.: 662,019

[22] Filed: Jun. 12, 1996

[30] Foreign Application Priority Data

Jul. 3, 1995 [JP] Japan ..... 7-189843

[51] Int. Cl.[6] ..... F22G 3/00

[52] U.S. Cl. ..... 122/459; 122/40

[58] Field of Search ..... 122/459, 487, 122/4 D

[56] References Cited

U.S. PATENT DOCUMENTS

| | | | |
|---|---|---|---|
| 3,279,441 | 10/1966 | Lippert et al. | 122/459 |
| 3,996,099 | 12/1976 | Faugeras et al. | 122/4 D |
| 4,095,563 | 6/1978 | Finger | 122/235 R |
| 4,989,551 | 2/1991 | Sardoff et al. | 122/487 |

FOREIGN PATENT DOCUMENTS 6-26603 2/1994 Japan .

*Primary Examiner*—Henry A. Bennett
*Assistant Examiner*—Gregory Wilson
*Attorney, Agent, or Firm*—Oblon, Spivak, McClelland, Maier & Neustadt, P.C.

[57] ABSTRACT

A low-temperature steam generating device comprises a pressure reducing unit 2 that lowers the pressure of steam to below atmospheric pressure by means of a vacuum pressure reducing valve 3 and a cooling unit 4 that changes steam with reduced pressure into saturated steam by lowering the temperature of the steam. The vacuum pressure reducing valve 3 is controlled based on the pressure and temperature of the steam with reduced pressure, whereas the cooling unit has a spray nozzle 5 that sprays cooling liquid into a passageway 61 at the entry end of a cooler proper 6 through which the steam with reduced pressure is admitted. The cooler proper 6 has a cylinder 60 through which the steam with reduced pressure passes and multistage constricting plates 65 disposed in the cylinder.

3 Claims, 3 Drawing Sheets

LOW-TEMPERATURE STEAM GENERATOR

FIELD OF THE INVENTION

This invention relates to a low-temperature steam generator that permits the maintenance of temperature between, or heating to between, approximately 30° C. and 100° C. (actually continuously variable from 30° C. to 130° C.) in various industrial fields, such as chemical, food, medicine, textile and biochemical industries.

DESCRIPTION OF THE PRIOR ART

When a lower-temperature heating source, as at 100° C. or below, is required in condensation, distillation, reaction, drying, temperature control, fermentation and other processes in various technical fields, warm water is often used because it has several advantages, such as being easy to obtain and use and involving no risk of overheating. However, warm water does not have a large heat capacity per unit rate of flow because it carries heat in the form of sensible heat. Now that, in addition, it is difficult to maintain constant water temperature throughout, maintenance of and heating at uniform temperature are unattainable. Therefore, uneven heating and other problems have resulted.

To solve these problems, the invention proposed a low-temperature steam generating device that uses low-temperature saturated steam as a heating medium at a low pressure below one atmospheric in Japanese Provisional Patent Publication No. H6-26603 of 1994.

This low-temperature steam generating device operates on the principle that the temperature of saturated steam can be maintained at a desired level by controlling the pressure of the saturated steam that is kept low because the relationship between the temperature and pressure of the saturated steam is fixed. This low-temperature steam generating device has a steam generating unit that produces steam, a vacuum pressure reducing unit that lowers the pressure of the produced steam to below atmospheric pressure, and a spray-type cooling unit that converts the low-pressure steam into saturated steam that is then sent to a low-temperature steam consuming device. Because latent heat constitutes a large part of the total heat, this low-temperature steam generating device increases the quantity of heat that can be used effectively and permits the maintenance of or heating at uniform temperature.

When the pressure of saturated steam is as low as below one atmospheric, however, even a slight difference in pressure, of only approximately 0.05 atmospheric, can create a significant temperature difference. (For example, the temperature of saturated steam at 0.10 atmospheric is approximately 45.4° C., whereas that of saturated steam at 0.15 atmospheric is approximately 53.6° C.) To ensure accurate temperature control, therefore, it is necessary to completely saturate the low-pressure steam, minimize control deviation, and attain a pressure corresponding to the desired saturation temperature.

To reduce the control deviation of steam pressure and attain a pressure corresponding to the desired saturation temperature, attempts have been made to improve the accuracy of control at the vacuum pressure reducing valve, cooling unit, and so on. Practically, however, it has remained difficult to stably attain a pressure corresponding to the desired saturation temperature due to an unexpected failure to completely saturate the low-pressure steam or an unexpected increase in pressure control deviation.

For example, the vacuum pressure reducing valve has a mechanism to open and close the valve by the use of the steam pressure on its secondary side and a spring. Because atmospheric pressure is contrasted with the pressure on the secondary side to create a valve actuating force by taking advantage of the difference between the two pressures, however, the valve actuating force varies with changes in atmospheric pressure. Substantial differences in atmospheric pressure between areas of high and low atmospheric pressures can cause significant pressure control deviation. Even if a spring balance or other valve actuating mechanisms are used, pressure control deviation can occur under different operating conditions, such as whether the flow rate is large or small. Thus, it is difficult to avoid variations in temperature control due to pressure fluctuations.

The spray-type cooling unit that saturates the low-pressure steam uses the drainage from the steam consumer as a cooling medium. Any metal powder or other foreign matters entrained in the drainage may clog the spray nozzle or cause other troubles that will vary the volume of sprayed liquid. Then, it is difficult to completely saturate the low-pressure steam and stabilize the steam temperature.

Although the spray-type cooler is suited for use as the cooling unit, it is neither simple nor compact but considerably large. The spray-type cooler completely saturates the low-pressure steam by lowering the temperature of the superheated steam resulting from a decrease in pressure by spraying cooling liquid. To achieve this, however, the cooling liquid must be diffused in a relatively long duct. To form such a duct using a straight pipe, the pipe length must be approximately 30 times greater than the diameter thereof in order to achieve satisfactory diffusion, contact and mixing of the cooling liquid. The need for such a long duct makes it difficult to obtain a simple and compact device to generate saturated steam for use in the stabilization of steam temperature.

SUMMARY OF THE INVENTION

An object of this invention is essentially to permit the use of low-temperature saturated steam as a heating medium for the maintenance of or heating at a temperature between 30° C. to 35° C. and 100° C. or above, and more particularly to provide a low-temperature steam generating device that minimizes the deviation in the control of steam pressure by eliminating as much as possible factors that inhibit the attainment of a pressure corresponding to the desired saturation temperature.

Another object of this invention is to provide a low-temperature steam generating device that reduces the deviation in the control of steam pressure and stably supplies completely saturated steam with reduced pressure by improving the accuracy of the pressure reducing unit that lowers the pressure of the steam generated in the steam generating unit to below atmospheric by means of a vacuum pressure reducing valve and the spray-type cooling unit that changes the low-pressure steam into saturated steam by lowering the temperature.

Still another object of this invention is to provide a low-temperature steam generating device that reduces the deviation in the control of steam pressure and stabilizes the steam pressure control further by providing temperature compensation because control temperature variations resulting from pressure variations caused by the vacuum pressure reducing valve is difficult to avoid.

Yet another object of this invention is to provide a low-temperature steam generating device having a compact spray-type steam cooler that efficiently generates completely saturated steam.

To achieve the above objects, a low-temperature steam generating device according to this invention, which comprises a steam generating unit, a pressure reducing unit that reduces the pressure of the steam generated in the steam generating unit to below atmospheric pressure, a cooling unit that changes the lower-pressure steam from the pressure reducing unit into saturated steam by cooling, and a vacuum producing unit leading from the cooling unit to a steam emitting system of a steam consuming device and applying vacuum suction to the emitted steam and collecting drainage therefrom has the pressure reducing and cooling units with improved control accuracy and a capability to stably supplies completely saturated steam with reduced pressure.

The pressure reducing unit comprises a vacuum pressure reducing valve that provides a preset pressure based on a signal from a pressure control unit without regard to atmospheric pressure and reduces the pressure of the steam from the steam generating unit to below atmospheric pressure, a pressure sensor detecting the pressure of the low-pressure steam admitted into the heat-exchange zone of the steam consuming device and connected to the pressure control unit that controls the output pressure of the vacuum pressure reducing valve to a preset pressure level, and a temperature sensor detecting the temperature of the heat-exchange zone of the steam consuming device and connected to the pressure control unit that controls the output pressure of the vacuum pressure reducing valve to a pressure corresponding to a desired saturation temperature so that the temperature in the heat-exchange zone is controlled thereto. The cooling unit comprises a spray nozzle provided in a passageway through which a low-pressure steam is admitted into a cooling device to discharge sprays of the drainage through a filter, with the cooling unit proper being made up of multistage perforated constricting plates that make narrower a cylindrical passageway through which the low-pressure steam passes and a water separation zone provided in a part of the cylindrical passageway that separates water droplets from the low-pressure steam.

The pressure of the steam generated by the steam generating unit of the low-temperature steam generating device described above is lowered to a preset pressure below atmospheric by the action of the vacuum pressure reducing valve in the pressure reducing unit because of vacuum suction applied at the vacuum producing zone on the emission side of the low-temperature steam consuming device. The steam whose pressure has been thus lowered is admitted into the cooler proper in the cooling unit. Because of the isentropic change, the steam with reduced pressure becomes superheated as a result of further pressure reduction. However, the cooling liquid sprayed from the spray nozzle at the entry end of the cooler proper changes the steam with reduced pressure into completely saturated steam, thereby stabilizing the steam temperature. The vacuum drainage collecting pump in the vacuum producing unit admits, and then afterwards emits, the steam at a constant temperature through the heat-exchange zone of the steam consuming device. The use of saturated steam with reduced pressure below atmospheric as a low-temperature heating medium permits the maintenance of temperature between, or heating to between, approximately 30° C. to 35° C. and 100° C.

Now that the relationship between the temperature and pressure of the saturated steam is fixed, the temperature of saturated steam can be controlled to a desired level by controlling its pressure even below atmospheric pressure. At a lower pressure, besides, latent heat constitutes a large part of the total heat. This permits increasing the quantity of heat that can be used effectively and provides a much higher coefficient of heat transfer, as compared with warm water. The result is uniform and stable heating.

As mentioned earlier, however, even a slight difference in pressure can create a significant temperature difference. Therefore, deviation in pressure control must be reduced to a minimum. The vacuum pressure reducing valve is unaffected by changes in atmospheric pressure because it provides a desired pressure based on a signal from the pressure control unit independently of atmospheric pressure. The vacuum pressure reducing valve does not create a valve actuating force by taking advantage of the difference between the two pressures. Therefore, an externally preset pressure can be always maintained.

The pressure and temperature of the low-pressure steam admitted into the heat-exchange zone of the steam consuming device are detected. The pressure control unit controls the output pressure of the vacuum pressure reducing valve to a preset level based on the detected pressure that is fed back thereto. At the same time, the output pressure of the vacuum pressure reducing valve is controlled to a pressure corresponding to the desired saturation temperature, whereby the temperature of the heat-exchange zone is controlled to the desired saturation temperature based on the detected steam temperature. This permits reducing the pressure of steam with minimum control deviation, Also, the steam consuming device remains stable without being affected by various variations and obtains the desired steam at low temperature in the heat-exchange zone thereof.

The collected drainage is sprayed through the spray nozzle in the low-pressure steam inlet passageway leading to the cooling device proper. Because the drainage is filtered to remove any metal powder or other foreign matters, the volume of the sprayed liquid remains unchanged. Therefore, the steam with reduced pressure is completely saturated, with the temperature thereof stabilized.

The cooling unit proper has the multistage perforated constricting plates that make narrower the cylindrical passageway. The superheated steam with reduced pressure passing therethrough repeats acceleration and deceleration and pressure variations, whereby the steam with reduced pressure becomes saturated with the addition of the cooling liquid. The multistage perforated constricting plates can very effectively saturate steam in a short duct. In a compact device, efficient diffusion to achieve complete saturation of low-pressure steam and stabilization of steam temperature is obtainable when the ratio of the area of the apertures in the perforated plates to the cross-sectional area of the duct leading to the cooling unit is held between 25% and 40%.

DETAILED DESCRIPTION OF THE DRAWINGS

Figure 1:
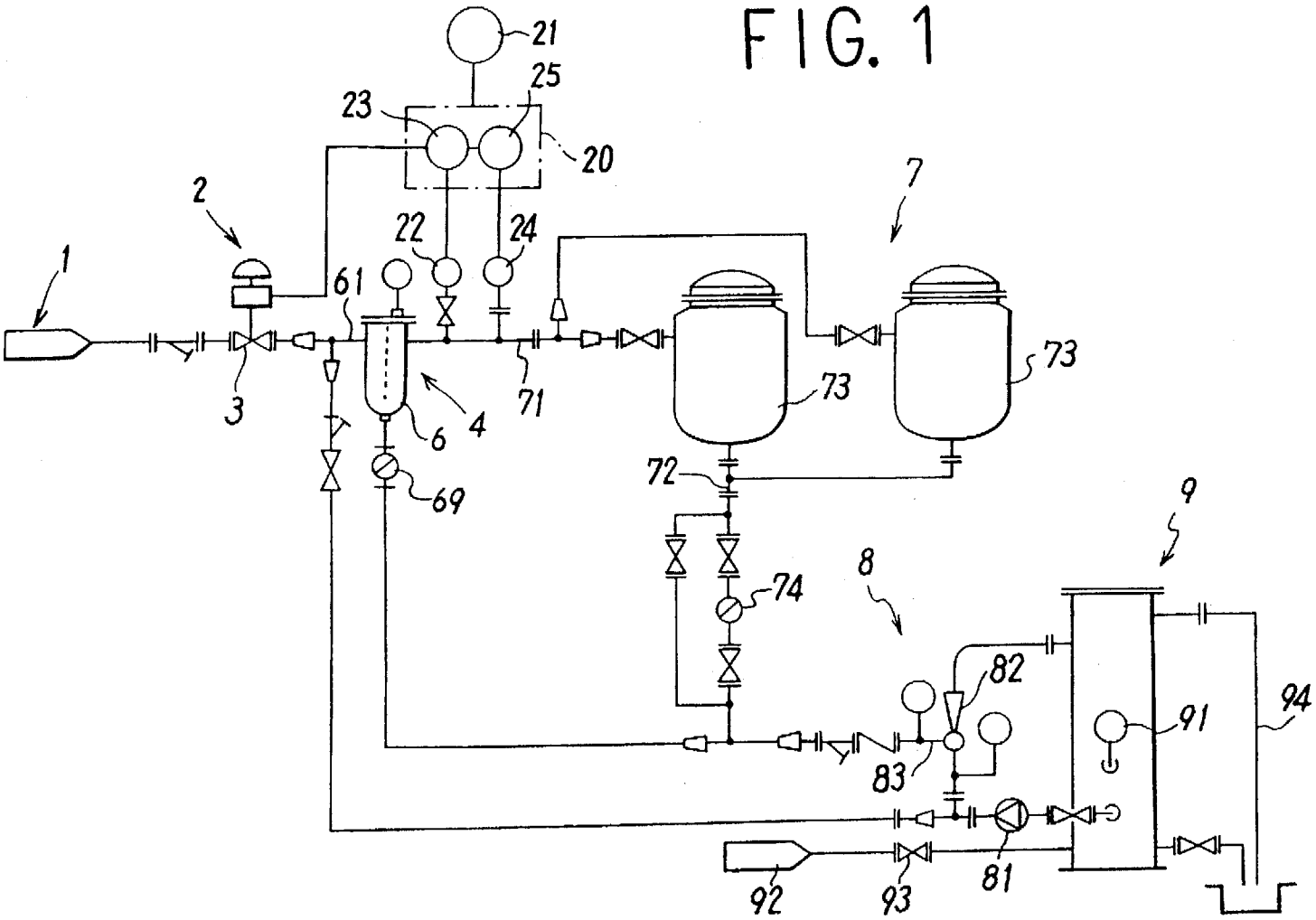
FIG. 1 is s block diagram showing the entire configuration of a low-temperature steam generating device according to this invention.
Figure 2:
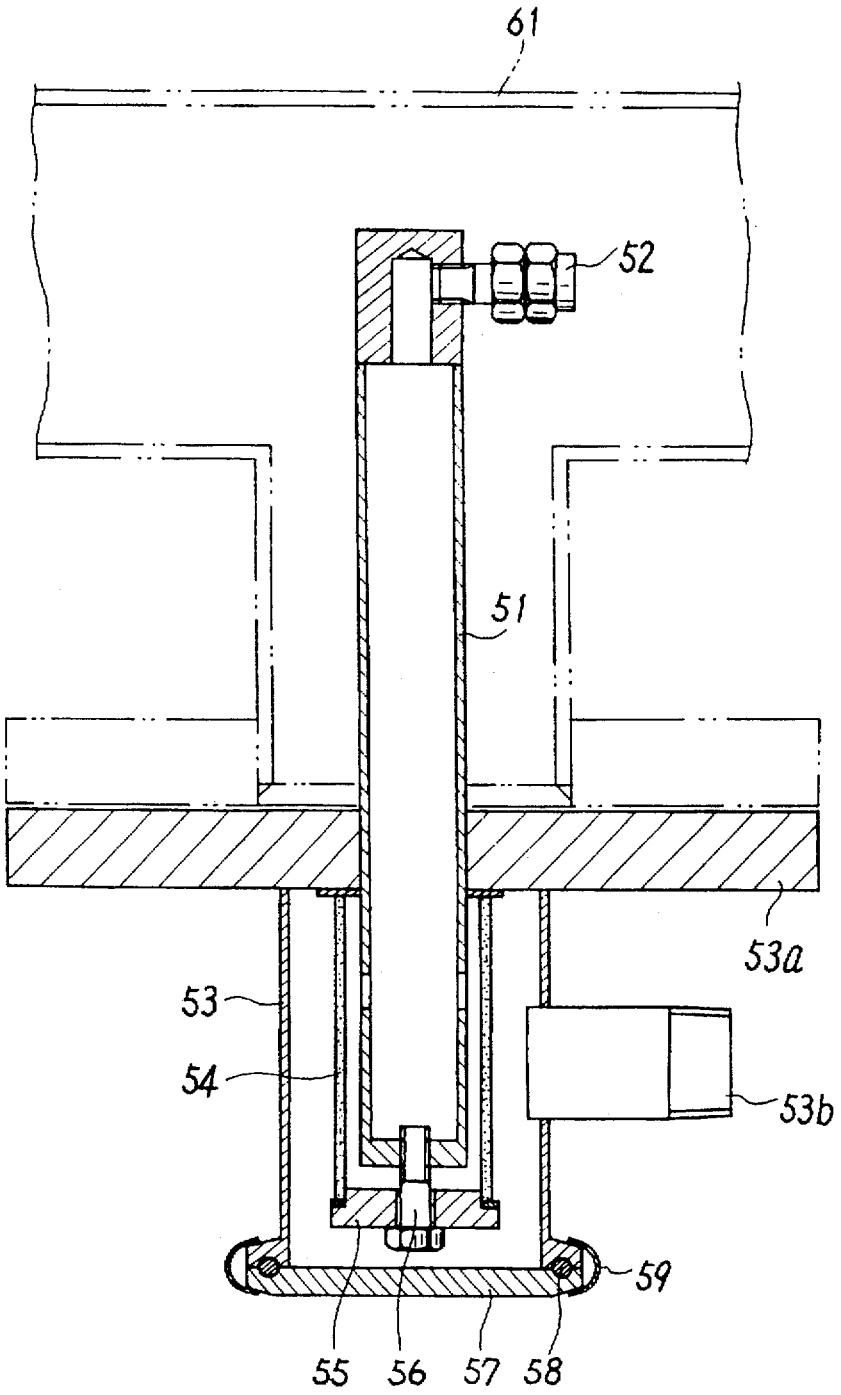
FIG. 2 is a cross-sectional view of a spray nozzle in a cooling unit of the same device.
Figure 3:
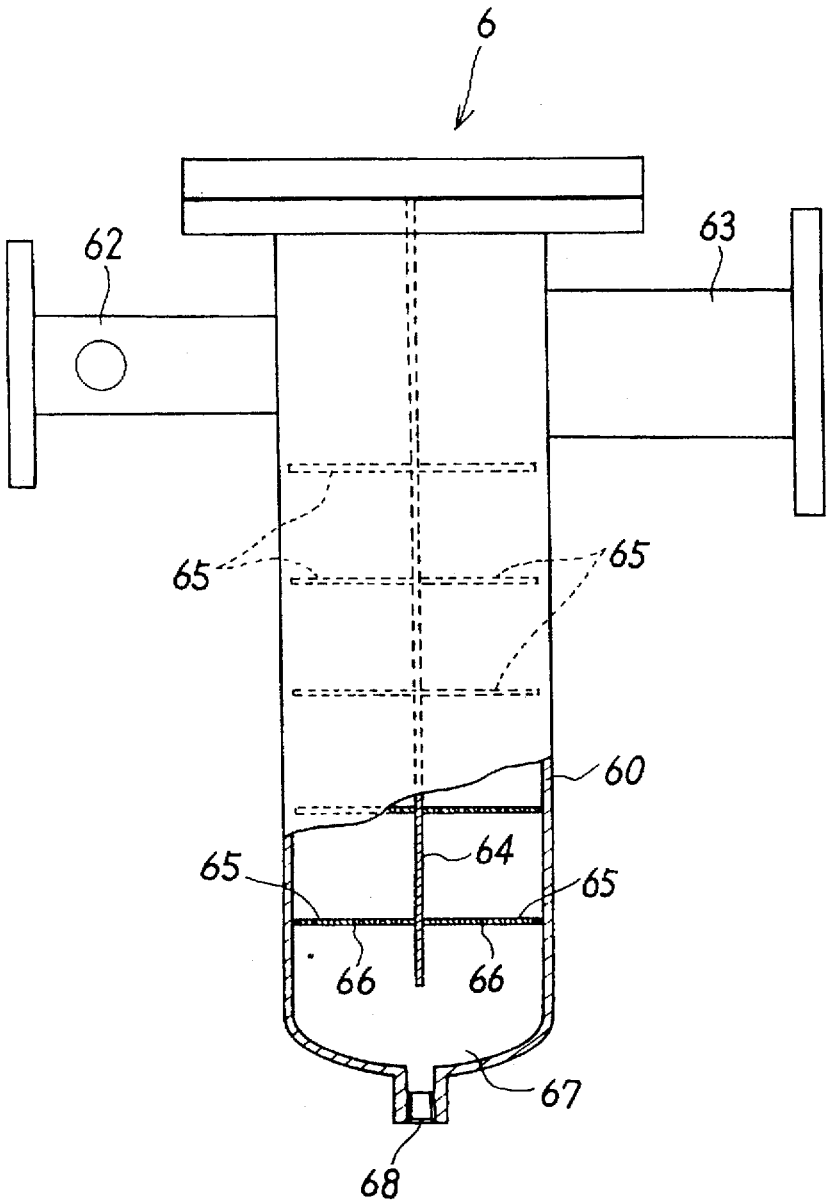
FIG. 3 is a side elevation of a cooler proper in the cooling unit of the same device.

FIG. 1 shows the entire configuration of a low-temperature steam generating device according to this invention, whereas FIGS. 2 and 3 show the cooling liquid spray nozzle with a filter in the cooling unit and the cooling unit proper therein.

The low-temperature steam generating device shown in FIG. 1 essentially comprises a steam generating unit 1 comprising a boiler to generate steam, an accumulator and so on, a pressure reducing unit 2 that lowers the pressure of the steam generated by the steam generating unit 1 to below atmospheric pressure by means of a vacuum pressure reducing valve 3, a cooling unit 4 comprising a cooler proper 6 that cools the steam at reduced pressure from the pressure reducing unit 2 by spraying drainage through a spray nozzle 5 (shown in FIG. 2), thereby producing saturated steam, and a vacuum producing unit 8 leading from the cooling unit 4 to a steam emitting system of a steam consuming device 7 and applying vacuum suction to the emitted steam and collecting drainage to a drainage collecting tank 9.

The vacuum pressure reducing valve 3 in the pressure reducing unit 2 reduces the pressure of steam on the secondary side to a given level below atmospheric and keeps the steam pressure at the reduced level. The vacuum pressure reducing valve 3, however, does not derive the valve actuating force from the difference between the pressure on the secondary side and atmospheric pressure, as one by the vacuum pressure reducing valve used in the conventional low-temperature steam generating device described earlier. The vacuum pressure reducing valve 3 is a high-precision automatic control valve that sets steam temperature and pressure at a desired level using electrical or other signals provided through a temperature-pressure controller 20, without regard to the atmospheric pressure that varies constantly. The temperature-pressure controller 20 can also change the set temperature freely based on a signal from an external setting machine 21.

Any of known mechanisms may be used as the vacuum pressure reducing valve 3 so long as the desired object is attained.

A pressure sensor 22 to detect the pressure of low-pressure steam admitted to the heat-exchange zone of the steam consuming device 7 is provided in a duct 71 through which the low-pressure steam flows into the steam consuming device and connected to a pressure controller 23 of the temperature-pressure controller 20. The pressure controller 23 outputs a signal to control the output pressure of the vacuum pressure reducing valve 3 to a desired level by feeding back the detected pressure to the vacuum pressure reducing valve 3 through the temperature-pressure controller 20. A temperature sensor 24 to detect the temperature in the heat-exchange zone of the steam consuming device 7 is provided in the low-pressure steam admission duct 71 and connected to a temperature controller 25 in the temperature-pressure controller 20. The temperature controller 25 controls the output pressure of the vacuum pressure reducing valve 3 to a pressure corresponding to a desired saturation temperature so that the desired saturation temperature is attained in the heat-exchange zone of the steam consuming device.

The pressure sensor 22 and temperature sensor 24 provided in the low-pressure steam inlet duct 71 may also be provided, for example, in the steam consuming device 7 itself or in the exit-end duct 72 of the steam consuming device so long as they can detect the pressure and temperature in the heat-exchange zone of the steam consuming device 7.

The cooling unit 4 comprises a spray nozzle 5 (shown in FIG. 2) having a filter that is provided in a duct 61 through which low-pressure steam is admitted into the cooler proper 6. The spray nozzle 5 sprays the drainage, which is delivered under pressure from the drainage collecting tank 9 by means of a pump 81, as cooling liquid. The cooler proper 6, shown in FIG. 3, brings the cooling liquid into adequate contact with the low-pressure steam and diffuses the former in the latter, thereby lowering the temperature of the steam.

As shown in FIG. 2, the spray nozzle 5 with a filter has a water pipe 51 that is inserted in the low-pressure steam inlet duct 61 leading to the cooler proper 6, with a nozzle tip 52 projecting toward the cooler proper 6 attached to the leading end thereof. A coupling joint **53*b* to admit the drainage from the drainage collecting tank 9 is attached to a filter cover 53 that is fastened to the outside of the duct 61 by means of a flange 53*a*. In the filter cover 53 is provided a cylindrical filter element 54 that filters the drainage admitted through the coupling joint 53*b* immediately before entering the water pipe 51. The filter element 54 is fastened over the water pipe 51 by mean of an end cover 55 that is detachably mounted on the outer end of the water pipe 51 with a bolt 56. To permit the removal of foreign matters from inside the cover 53 and the exchange of the filter element 54 by loosening the bolt 56, a detachable cover 57 is attached to the end of the cover 53 by means of a metal clamp 59, with a sealing ring 58** disposed therebetween.

As such, the drainage from the drainage collecting tank 9 is sprayed through the spray nozzle 5 (or the nozzle tip 52) into the low-pressure steam inlet duct 61 leading to the cooler proper 6. Because the drainage is filtered before reaching the spray nozzle 5, metal powder and other foreign matters are removed, thus ensuring uniform and stable spraying.

The cooler proper 6 has a cylinder 60 that forms a passageway for the low-pressure steam, as illustrated in FIG. 3. The cylinder 60 has an inlet port 62 and an outlet port 63 that are disposed opposite each other in the upper part thereof. A partition 64 not long enough to reach the bottom of the cylinder 60 divides the inside of the cylinder into an inlet- and an outlet-side spaces. The horizontal area for the passage of the low-pressure steam in a resulting U-shaped passageway is reduced by multistage constricting plates 65 with many perforations 66. A water separation zone 67 is provided in the curved bottom of the cylinder 60 to centrifugally separate water droplets from the low-pressure steam that passes through that zone at high speed while changing the direction of flow. A drain 68 to discharge the separated drainage is provided at the lowermost end of the cylinder 60.

Limiting the ratio of the area of the apertures in the perforated plates to the cross-sectional area of the passageway in the cooler proper 6 between 25% and 40% permits obtaining a compact device that assures efficient diffusion, complete saturation of steam at low temperature and effective stabilization of steam temperature. Preferably, the ratio should be limited between 30% and 35%. A proper ratio must be selected by taking into account the relationship thereof with the size of the cooler proper 6 because reducing the ratio inevitably accompanies an increase in the size of the cooler proper 6.

When the multistage perforated constricting plates 65 is provided in the cylinder 60 of the cooler proper 6, the stream of superheated steam with reduced pressure picks up the speed when passing through the perforations 66 therein and slows down afterwards, repeating the cycle at each plate. The resulting repetitive variations in pressure rapidly saturates the steam with reduced pressure to which cooling liquid has been added. The multistage constricting plates 65 very effectively saturate steam in a short passageway. While the steam passes through the perforations 66 in the constricting plates 65 at such high speeds as tens of meters per second. However, pressure loss is insignificant because the density of the steam is low.

To the cooling unit 4 is connected a low-temperature steam consuming device 7 that performs log-temperature heating between 30° C. and 100° C. or above in condensation, distillation, reaction, drying, temperature control, fermentation and other processes. This steam consuming device 7 may comprise two condensation tanks 73. The vacuum producing unit 8 that applies vacuum suction to the emitted steam and collects drainage through a steam trap 74 is connected to an outlet duct 72 through which the used steam is discharged therefrom.

The steam that has released latent heat is condensed in the heat-exchange zone of the steam consuming device 7. The resulting condensate flows through the outlet duct 72 into the steam trap where the liquid and vapor are separated, then the separated liquid is collected by a vacuum drainage collecting pump in the vacuum producing unit 8.

The vacuum producing unit 8 supplies the drainage, which is transferred under pressure from the drainage collecting tank 9 by the pump 81, as the driving liquid to a jet pump 82 that constitute a vacuum drainage collecting pump. The liquid emitted from the nozzle of the jet pump creates a negative pressure at a drainage inlet port 83, whereby the steam is drawn from the discharge system of the steam consuming device 7 under vacuum and the pressure on the secondary side of the pressure reducing unit 2. At the same time, the drainage discharged from the outlet duct 72 under the low-pressure steam consuming device 7 and the drain 68 at the lowermost end of the cylinder 60 of the cooler 6 is separated into the liquid and vapor by the steam traps 74 and 69 that are actuated by a slight pressure differential, with the separated liquid collected by the drainage collecting tank 9 together with the driving liquid.

To efficiently increase the degree of vacuum in the jet pump 82, it is preferable to set the temperature of the circulated driving liquid that leaves the drainage collecting tank 9 and returns thereto through the pump 81 and the jet pump 82 at a temperature somewhat lower than the temperature of the saturated steam in the steam consuming device 7. Therefore, a temperature sensor 91 is provided in the drainage collecting tank 9 to determine the temperature of the driving liquid. Then, a make-up water valve (93) in the duct from a make-up water source 92 is controlled based on the water temperature thus determined to permit the supply of an appropriate quantity of cold make-up water. Reference numeral 94 designates an overflow pipe connected to the drainage collecting tank 9.

In the low-temperature steam generating device described above, the vacuum pressure reducing valve 3 in the pressure reducing unit 2 lowers the pressure of the steam generated in the steam generating unit 1 to a desired level below atmospheric pressure. The steam whose pressure has been thus lowered then flows into the cooler proper 6 in the cooling unit 4. Because of the isentropic change, the steam with reduced pressure becomes superheated as a result of further pressure reduction. However, the spray nozzle 5 at the entry end of the cooler proper 6 sprays cooling liquid to make the steam saturated. The repetitive acceleration and deceleration of the steam caused by the multistage constricting plates 65 in the cooling proper 6 cause repetitive pressure variations. Then, the steam with reduced pressure becomes rapidly saturated and, as a consequence, brings about the stabilization of steam temperature. The jet pump 82 in the vacuum producing unit 8 then draws out the used steam through the heat-exchange zone of the steam consuming device 7.

When the pressure of saturated steam is lower than atmospheric, even a slight pressure difference can result in a large temperature difference as mentioned earlier. Therefore, pressure control deviation must be reduced to a minimum. However, the pressure reducing unit 2 does not use the difference between the steam pressure and atmospheric pressure in creating the valve actuating force. Instead, the vacuum reducing valve 3 provides a desired pressure based on a signal from the pressure controller 20, without depending on the atmospheric pressure. Therefore, the externally set pressure can be maintained without being affected by the atmospheric pressure.

Not only the pressure but also the temperature of the steam with reduced pressure admitted into the heat-exchange zone of the steam consuming device 7 are determined. The output pressure of the vacuum pressure reducing valve 3 is controlled to a desired level based on the detected pressure fed back thereto. Besides, the output pressure of the vacuum pressure reducing valve 3 is controlled to a pressure corresponding to a desired saturation temperature so that the desired saturation temperature is obtained in the heat-exchange zone based on the steam temperature thus detected. Accordingly, the steam pressure can be reduced with minimal control deviation. Also, the steam consuming device remains stable without being affected by various variations and obtains the desired steam at low temperature in the heat-exchange zone thereof.

With saturated steam at 60° C. or below, an error of 0.01 $kg/cm^2$ in steam pressure generally corresponds to 1° C. or more of steam temperature. The steam generating device of this invention described above proved to keep the error under plus or minus 1° C. over a wide temperature range at and below 100° C.

The low-temperature steam generating device according to this invention permits the maintenance of and heating at temperatures between 30° C. to 35° C. and 100° C. or above using saturated steam at low temperature as a heating medium. It also minimizes the deviation in steam pressure control by eliminating as many factors as possible that might obstruct the attainment of a pressure corresponding to a desired saturation temperature. In the pressure reducing unit where the vacuum pressure reducing valve lowers the pressure of the steam generated in the steam generating unit to below atmospheric, provisions are made to avoid the production of variations in saturation temperature that might result from the use of pressure information fed back and to ensure a greater degree of stabilization by temperature compensation. Furthermore, the accuracy of control is increased in the cooling unit with a spray that changes the steam with reduced pressure into saturated steam. Thus, the low-temperature steam generating device of this invention minimizes the deviation in steam pressure control and assures the stable supply of completely saturated steam with reduced pressure.

What is claimed is:

1. In a low-temperature steam generator comprising a steam generating unit, a pressure reducing unit that reduces pressure of steam generated in the steam generating unit to below atmospheric pressure, a cooling unit that changes the lower-pressure steam from the pressure reducing unit into saturated steam by cooling, and a vacuum producing unit leading from the cooling unit to a steam emitting system of a steam consuming device that applies vacuum suction to the emitted steam and collects drainage therefrom, the improvement comprising:

a vacuum pressure reducing valve disposed in said pressure reducing unit so as to provide low pressure steam at a preset output pressure based on a signal from a pressure control unit without regard to atmospheric pressure and reduces the pressure of the steam from the steam generating unit to below atmospheric pressure;

a pressure sensor that detects pressure of the low-pressure steam admitted into a heat-exchange zone of the steam consuming device and connected to the pressure control unit that controls the output pressure of the vacuum pressure reducing valve to the preset output pressure level; and a temperature sensor that detects a temperature of the heat-exchange zone of the steam consuming device and connected to the pressure control unit that controls the output pressure of the vacuum pressure reducing valve to a pressure corresponding to a desired saturation temperature so that the temperature in the heat-exchange zone is controlled thereto;

wherein the cooling unit comprises, a spray nozzle provided in an entrance duct through which the low-pressure steam is admitted into the cooling unit to discharge sprays of drainage having been filtered through a filter, and a cooler proper connected to said entrance duct and constructed of multistage perforated constricting plates that make a narrow cylindrical passageway through which the low-pressure steam passes and a water separation zone provided in a part of the cylindrical passageway that separates water droplets from the low-pressure steam.

2. The improvement according to claim 1, wherein the water separation zone of the cooler proper and the heat-exchange zone of the low-temperature steam consuming device are connected to a vacuum drainage collecting pump that comprises a jet pump disposed in a steam trap of the vacuum generating unit.

3. The improvement according to claim 1 or 2, wherein a ratio of an area of apertures in the perforated constricting plates to a cross-sectional area of the entrance duct leading to the cooler proper is held between 25% and 40%.

* * * * *